United States Patent [19]

Tyke

[11] 4,344,244

[45] Aug. 17, 1982

[54] SIGNAGE SYSTEM AND METHOD OF MAKING SAME

[76] Inventor: Charles R. Tyke, 7427 Leyton, SE., Ada, Mich. 49301

[21] Appl. No.: 158,987

[22] Filed: Jun. 12, 1980

[51] Int. Cl.[3] ..... G09F 7/02; G09F 7/22; G09F 11/00

[52] U.S. Cl. ..... 40/611; 40/616; 40/491; 40/490

[58] Field of Search ..... 40/606, 611, 610, 618, 40/605, 616, 575, 576, 617, 620, 622, 570, 572, 574, 578, 491, 490, 489

[56] References Cited

U.S. PATENT DOCUMENTS

| | | | |
|---|---|---|---|
| 887,882 | 5/1908 | Waugh | 211/169 |
| 949,578 | 2/1910 | Keens | 40/618 |
| 1,779,190 | 10/1930 | Send | 40/618 |
| 1,964,404 | 6/1934 | Schroeder | 40/611 |
| 2,160,544 | 5/1939 | Hector | 40/492 |
| 2,182,441 | 12/1939 | Lee | 40/575 |
| 2,764,751 | 9/1956 | Gnadke | 246/122 A |
| 2,802,291 | 8/1957 | Back et al. | 40/611 |
| 3,154,870 | 11/1964 | Hopp et al. | 40/605 |
| 3,402,493 | 9/1968 | Mellyn et al. | 40/563 |
| 3,778,915 | 12/1973 | Freeman et al. | 40/605 |
| 3,914,890 | 10/1975 | Behlen, Jr. | 40/611 |
| 4,000,573 | 1/1977 | Cohen | 40/611 |
| 4,059,914 | 11/1977 | Dobson | 40/611 |

OTHER PUBLICATIONS

Sales brochures of Architectural signing, pp. 198–199, 11–1981.

Brochure, p. 87, of Lettering Specialists, Inc., 11–1981.

Brochure, p. 27, Informational and Directional Signage, by Architectural Signing, Inc., 11–1981.

Environmental Graphic Systems, Inc. brochure, 1979.

*Primary Examiner*—Gene Mancene

*Assistant Examiner*—Michael J. Foycik, Jr.

*Attorney, Agent, or Firm*—Waters, Lesniak & Willey

[57] ABSTRACT

A signage system includes a frame including a vertical support plate having horizontal sign mounting flanges on at least one side of the plate. Removable plate-shaped lettering inserts are mounted on the frame by mounting flanges on the back surface of the lettering inserts that mate with the mounting flanges on the support plate. The flanges are engaged by fitting the mounting flanges of the lettering insert endwise on the ends of the mounting flanges for the support plate and sliding the lettering inserts horizontally onto the frame. Removable end caps cover the ends of the frame and lettering inserts, with the end caps including at least two opposed resilient fingers that fit over and press resiliently against the opposite sides of the support plate to hold the end caps on the frame. The end caps are formed by joining together two identical halves. The end caps include a central alignment tab that fits between two horizontal mounting flanges on the frame in order to position the end cap in proper vertical position on the frame. The frame includes T-shaped channels on the upper and lower surfaces of the frame for joining sections of frame together and attaching the frame to various mounting devices for displaying the sign.

15 Claims, 25 Drawing Figures

SIGNAGE SYSTEM AND METHOD OF MAKING SAME

BACKGROUND OF THE INVENTION

1. Field of the Invention

The present invention relates to a signage system and more particularly to an interior signage system wherein individual lettering inserts are removable and insertable easily and without the use of any tools.

2. Description of the Prior Art

Interior signage systems are widely used in any number of applications, including offices, hospitals and the like. Such signage systems include the identity of and direction toward various departments and offices, as well as listing the names of various personnel. An almost infinite variety of types of signs is desirable, from signs including a single name or title to a sign including a long list of names of personnel.

A single signage system, wherein a uniform frame or a series of interconnected frames can be used for a wide variety of interior signs is desirable, and it is also desirable that such signs be capable of displaying signage information on both sides of the frame. Removal and insertion of various inserts in order to permit modification of the signage system without the use of tools or the like is also desirable.

Presently existing signage systems are deficient. They are not able to provide a single universal system that can be used in a wide variety of circumstances and provide for easy interchangeability of lettering inserts without the necessity of any tools.

SUMMARY OF THE INVENTION

In accordance with the present invention, a signage system comprises a frame including a vertical support plate having front and back surfaces and horizontal frame mounting flanges on at least one side of the plate. Frame mounting flanges have ends facing the side edges of the support plate. At least one removable plate-shaped lettering insert is mountable on the frame, with the lettering insert having signage on the front surface thereof and mounting flanges on the back surface thereof. The lettering insert mounting flanges mate with the mounting flanges on the support plate to hold the lettering insert on the frame. The lettering inserts are mountable on the frame by fitting the insert mounting flanges endwise on the ends of the sign mounting flanges on the frame and sliding the lettering inserts horizontally on the frame. Removable end caps cover the ends of the frame and lettering inserts. The end caps comprise at least two opposed resilient fingers that fit over and press resiliently against opposite sides of the support plate to hold the end caps on the frame. The end caps are removable by pulling the end caps horizontally away from the frame, thus exposing the ends of the lettering inserts and permitting removal of the lettering inserts by sliding them horizontally off the mounting flanges through the opened end. Frame mounting means are attachable to the frame for mounting the sign for visual display in a number of ways.

The frame mounting flanges comprise a series of spaced upper and lower horizontal flanges having inwardly facing lips on the ends of the flanges, such that the flanges and lips form open ended T-shaped channels on the support plate. The frame also includes T-shaped channels on the upper and lower ends of the frame for interconnecting frame sections and mounting the frame on various mounting devices.

The end caps are desirably formed in two halves, with each half being identical. The end caps comprise desirably two pair of opposed resilient fingers and at least one alignment tab that abuts the mounting flanges on the support plate in order to align the end cap in proper vertical position on the frame.

The lettering inserts are flat plastic inserts having L-shaped mounting flanges or tabs on the back surface thereof, with the tabs or flanges being attached so as to fit under and engage the lips on the frame mounting flanges. Alignment projections also are formed in the rear surfaces of the inserts, with these alignment projections engaging flanges in the frame in order to hold the signs in proper vertical alignment on the frame.

The present invention also includes a number of mounting devices for supporting the signs for visual display. Such mounting devices include a perpendicular mount, a mount for a suspended ceiling, a fabric panel mounting pin, a conference room mounting device, a mounting device for mounting the signage on the top of an open plan panel, a desk mounting device, a mounting device for suspending the sign from a high ceiling, and a wall mounting plate.

The lettering inserts may be formed from plastic extrusions or an injection molding process. A special process is provided for forming the L-shaped tabs of the lettering inserts in an injection molding process.

These and other advantages and features of the present invention will hereinafter appear. For purposes of illustration but not of limitation, a preferred embodiment of the present invention is described in detail below and shown in the appended drawings.

DETAILED DESCRIPTION OF THE PREFERRED EMBODIMENTS

Figure 2:
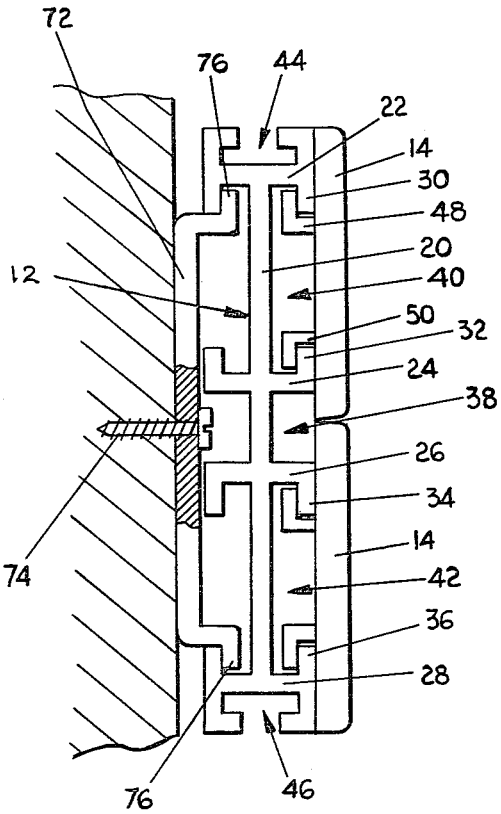
FIG. 2 is a partially broken view taken along lines 2—2 of FIG. 1.
Figure 3:
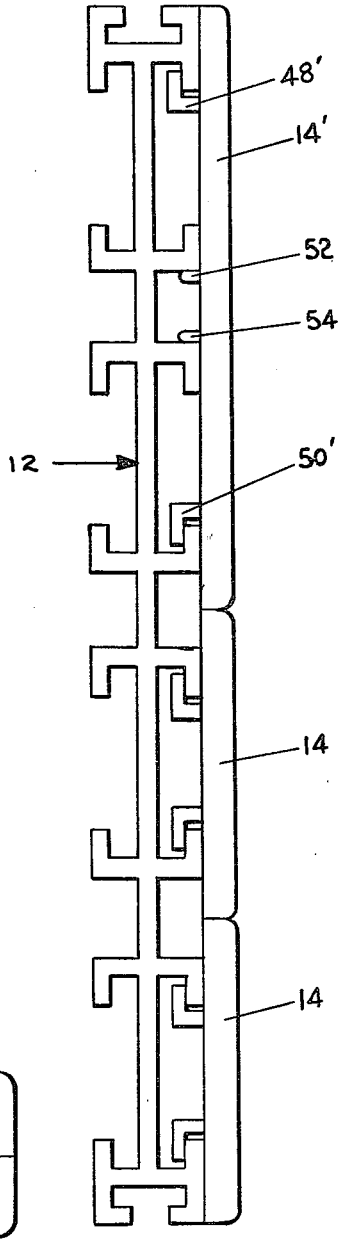
FIG. 3 is a side or end view showing a section of frame adapted to accommodate four (4) units of signs, with one sign two units high and two signs one unit high being attached to the frame.
Figure 8:
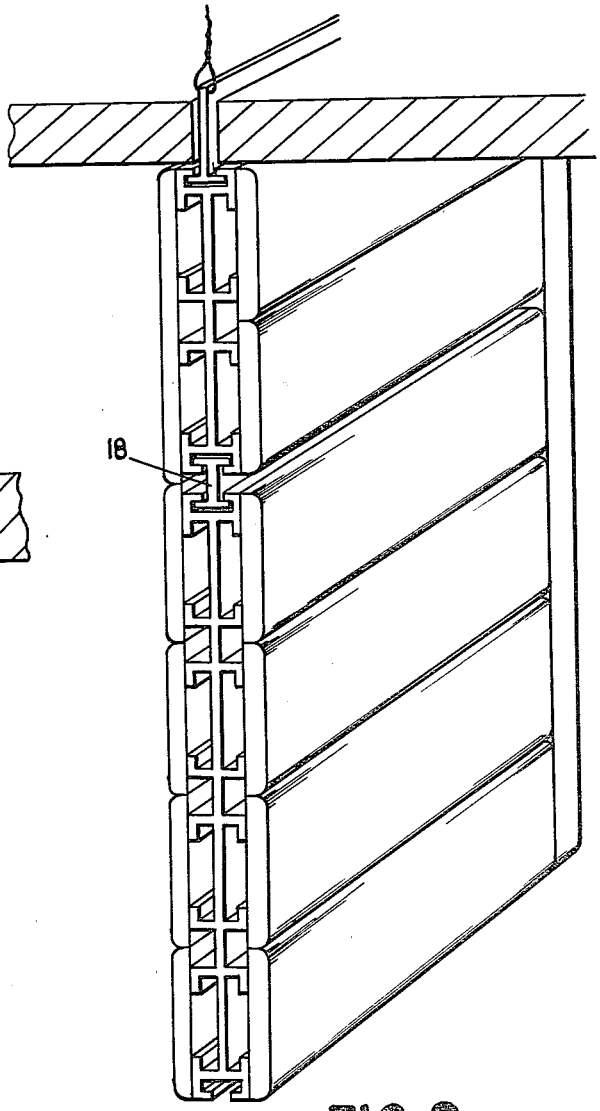
FIG. 8 is a perspective view showing a signage system incorporating two interconnected sections of frame suspended from a ceiling, with the end caps removed to show the suspension mechanism.

Referring now to the drawings, a signage system 10 constructed in accordance with the present invention comprises a frame 12, removable lettering inserts or name plates 14 insertable into the frame, removable end caps 16 that enclose the side edges or ends of the signage system, and a frame mounting device of one of several types for positioning the sign for visual display. As shown in FIGS. 2 and 3, the frame can be formed of various lengths, and as shown in FIG. 8, two (2) sections of frame can be joined together by means of an I-beam connector 18 or the like.

Figure 1:
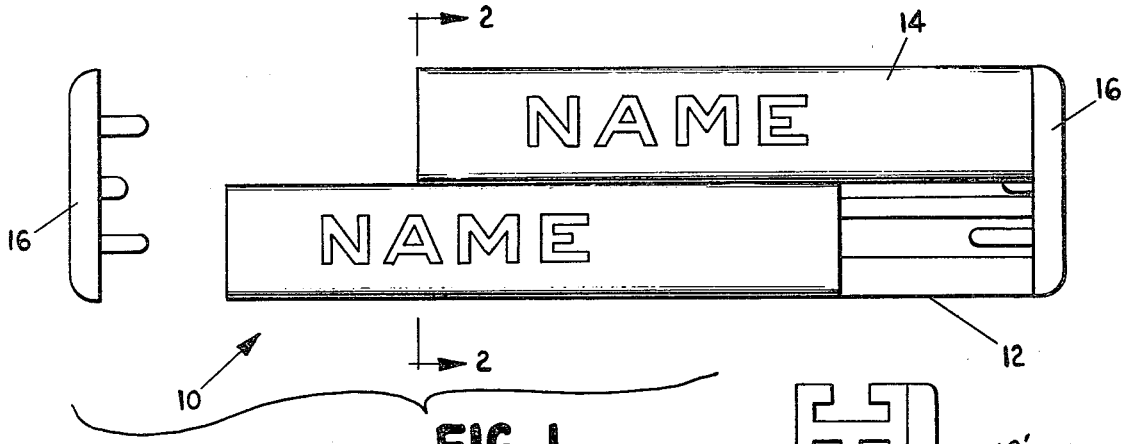
FIG. 1 is a front or face view of a wall mounted version of the present invention, showing the end caps removed and one of the lettering inserts in the process of being removed.

Referring to FIGS. 1 and 2, the frame 12 comprises a vertical support plate 20 having a series of frame mounting flanges 22, 24, 26 and 28 extending outwardly from the front and rear surfaces of the support plate. Mounting flanges 22 and 24 have inwardly facing lips 30 and 32 such that the space between mounting flanges 22 and 24 forms a horizontally positioned T-shaped channel with open ends facing the side edges of the support plate. Similarly, flanges 26 and 28 have inwardly facing lips 34 and 36 such that a second or lower T-shaped channel is formed between flanges 26 and 28. Flanges 24 and 26 are spaced apart along the support plate 20 so as to form a separate channel 38 between those flanges. The upper channel is identified herein by numeral 40 and the lower channel is identified by numeral 42. The rear or back side of the support plate is identical in configuration to the front side.

A separate T-shaped channel 44 is formed along the upper edge of frame 12 and a similar T-shaped channel 46 is formed along the lower edge of frame 12. Frame 12 is formed as an aluminum extrusion.

The section of frame shown in FIG. 2 is a single unit in the system of the present invention. Desirably, this section of frame is about two inches high and can incorporate two one-inch lettering inserts as shown in FIG. 2, or it can incorporate one two-inch lettering insert 14' (as shown in the upper half of the frame section shown in FIG. 3).

The next largest unit size of frame of the system of the present invention is shown in FIG. 3, wherein four (4) T-shaped channels are formed along the vertical support plate. This section of frame is approximately four inches high and incorporates a two-inch sign 14' as well as two one-inch signs 14.

Each of the signs is mounted in the T-shaped slots of the frame by means of outwardly facing L-shaped mounting flanges 48 and 50, with the leg of mounting flange 48 extending upwardly and the leg of mounting flange 50 extending downwardly. These mounting flanges engage the underside of the lips on the mounting flanges in the frame and retain the lettering inserts in position on the frame.

The lettering inserts are insertable in the frame in the manner shown in FIG. 1, with the mounting flanges on the lettering insert being fit into mating engagement with the ends of the mounting flanges on the frame and then the lettering inserts being slid horizontally onto the frame. The lower lettering insert in FIG. 1 is shown in a partially inserted position.

Figure 10:
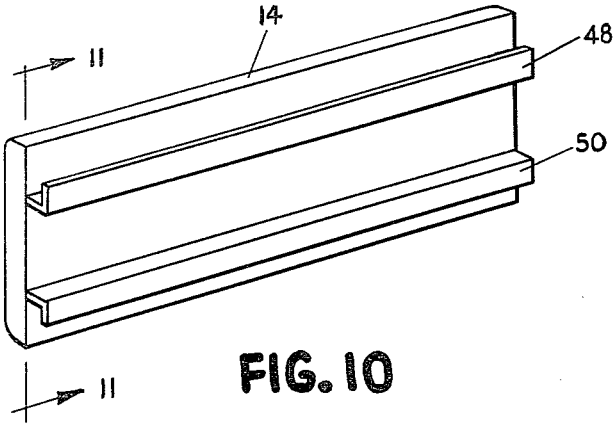
FIG. 10 is a perspective view of an extruded lettering insert.
Figure 11:
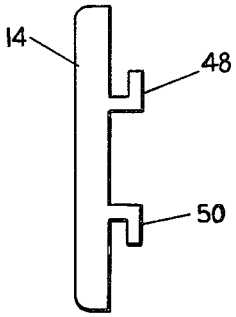
FIG. 11 is a view taken along lines 11—11 of FIG. 10.
Figure 12:
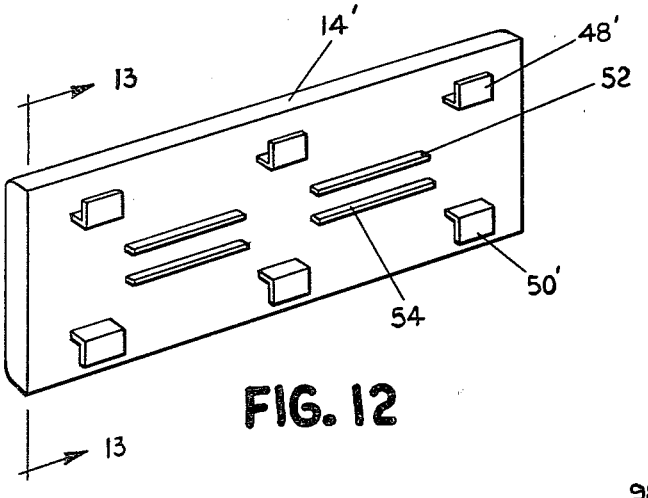
FIG. 12 is a perspective view of a lettering insert formed by an injection molding process.
Figure 13:
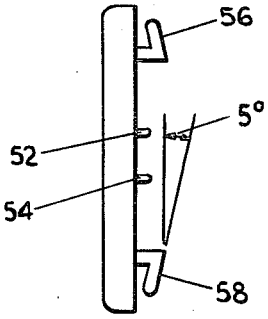
FIG. 13 is a view taken along lines 13—13 of FIG. 12.

The construction of the lettering inserts is shown best in FIGS. 10–13. The lettering insert of FIGS. 10 and 11 is formed of an extruded thermoplastic material, with flanges 48 and 50 running the entire length of the insert. Because of some quality control considerations in the formation of extruded parts, more precise dimensional tolerances can be accomplished by making the lettering inserts from injection molded components. A lettering insert 14' formed of injection molded thermoplastic material is shown in FIGS. 12 and 13. In this embodiment, instead of having mounting flanges running the entire length of the product, mounting flanges 48' and 50' are short tabs formed at three locations along the top and three locations along the bottom in horizontal alignment with each other. In addition, spaced alignment projections 52 and 54 are formed in the rear surface of lettering insert 14' and these engage the outside surface of flanges 24 and 26 in the manner shown in FIG. 3 in order to hold the lettering insert in proper alignment on the frame.

In the practice of the present invention, alignment projections 52 and 54 are employed on lettering inserts that are two inches high or higher but are not employed on one-inch lettering inserts.

As shown in FIG. 13, in order to insure a snug fit between the lettering inserts and the mounting flanges of the frame, legs 56 and 58 of mounting flanges 48' and 50' are inclined downwardly toward the surface of the lettering insert at a slight angle of approximately five degrees so that the legs will engage snugly the flanges on the frame.

After the lettering inserts have been inserted into the frame, the ends of the frame and the ends of the lettering inserts are enclosed by removable end cap 16. These end caps include a resilient fastening mechanism so that the end caps can be inserted on and removed from the side edges of the frame manually and without the use of any tools.

Figure 4:
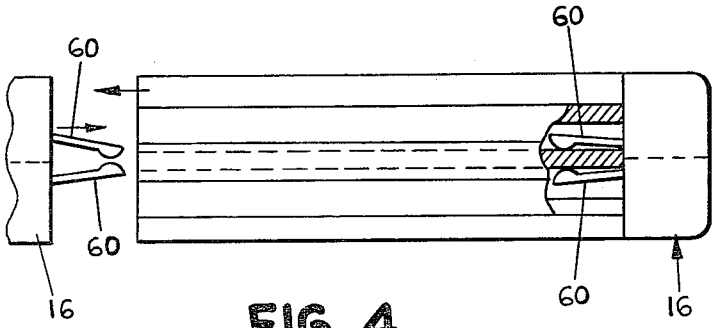
FIG. 4 is a partially broken top view of the present invention showing the manner in which the end caps grip the support plate of the frame.
Figure 7:
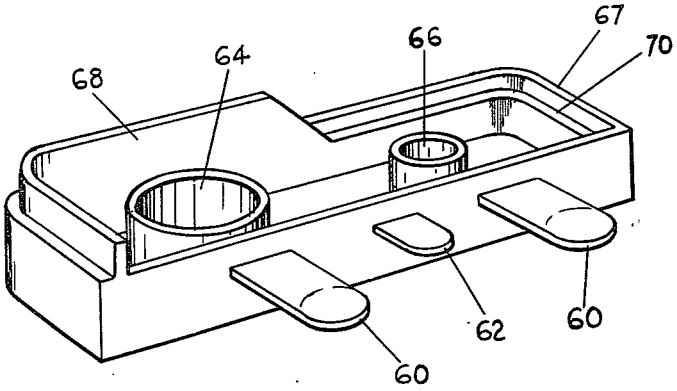
FIG. 7 is a perspective view of one of two identical halves of the end cap of the present invention.
Figure 6:
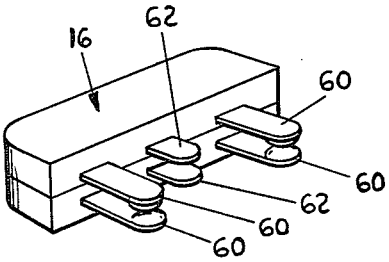
FIG. 6 is a perspective view of an assembled end cap of the present invention.

The construction of the end caps is best shown in FIGS. 6 and 7. A completed end cap 16 includes two pair of outwardly extending resilient fingers 60 with each pair of resilient fingers having a beaded or expanded end thereon. As shown in FIG. 4, fingers 60 taper inwardly toward each other as they extend outwardly from the end cap. Each pair of fingers fits over the edge of the vertical support plate of the frame, and in doing so these fingers are resiliently spread apart so that they resiliently press inwardly against the support plate. This constitutes sufficient pressure to hold the end caps firmly in place on the frame until the end caps are to be removed for removing or charging the lettering inserts in the sign.

In addition to the two pairs of opposed resilient fingers, the end caps also have a pair of alignment tabs 62 extending outwardly from the center of the end cap. These alignment tabs fit between the adjacent flanges on adjoining sections of horizontal T-shaped slots on the surface of the support plate. The alignment tabs are accurately formed so that they just fit into channel 38. These alignment tabs hold the end cap in proper vertical alignment along the frame.

As shown in FIG. 7, the end caps are formed in two identical sections which are fused together. Each identical section includes two resilient fingers 60 and one alignment tab 62. The interior of the section includes two annular bosses, one boss 64 having an enlarged diameter and the other boss 66 being of smaller diameter. The internal opening in boss 64 is shaped so that boss 66 will fit snugly within boss 64. The outer edges of each section 67 of the end cap are formed with interlocking ridges that fit together when two sections are placed together. One half of the section has an inner ridge 68 that extends upwardly, while the other half of the section includes a recessed area 70 into which ridge 68 can fit.

Figure 5:
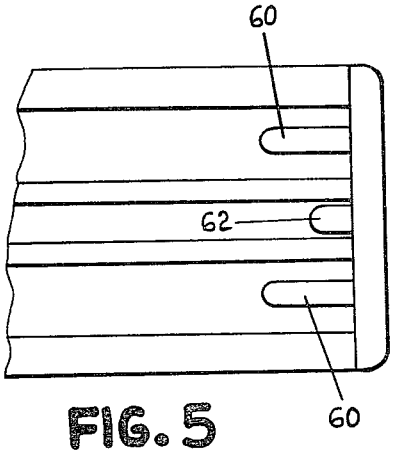
FIG. 5 is a front view showing an end cap mounted in position on the frame, with the alignment tabs of the end cap in position in the frame.

The two sections of the end cap fit together in the manner shown in FIG. 6. As thus assembled, the end cap fits snugly on the edge of the frame in the manner shown in FIG. 5 in order to hold the lettering inserts in place and enclose the ends of the frame.

In order to remove lettering inserts, it is a simple matter to pull the end cap off of the frame, slide the lettering insert out of the frame and replace it with a different lettering insert. The end cap can then be clipped back into place on the frame. No tools are required for this operation and yet the end cap is maintained snugly in proper position on the frame.

The present invention includes a number of different mounting devices for visually displaying the signage of the lettering inserts. In FIG. 2, the sign is mounted to the surface of a wall by means of a mounting plate 72 that is attached to the wall by means of a threaded fastener 74 or the like. Mounting plate 72 has outwardly extending mounting flanges 76 that engage the mounting flanges in the back of the frame in the same manner as the mounting flanges on the rear surfaces of the lettering inserts.

Figure 17:
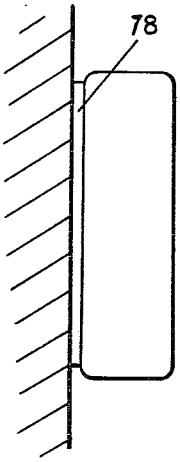
FIG. 17 is a side view showing the pressure sensitive adhesive or magnetic mounting device of the present invention.

When the signage is to be affixed to a hard flat wall surface, as shown in FIG. 17, a blank lettering insert on the rear surface of the frame can be affixed to the wall by means of a pressure sensitive adhesive 78 instead of by a threaded fastener. Alternatively, a magnetic attachment mechanism could be employed in attaching the sign to a metal wall. A Velcro-type fastener also can be used.

Figure 9:
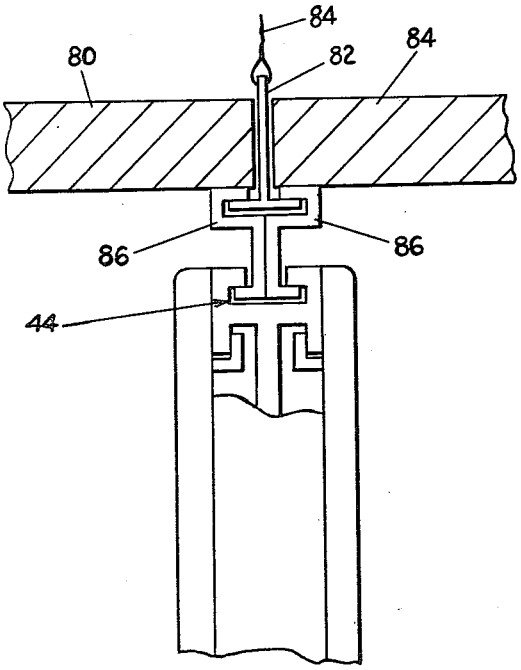
FIG. 9 is a partially broken view showing the frame mounting mechanism used for suspending the frame from a T-bar support of a suspended ceiling construction.

The manner in which a sign is suspended from a T-bar grid system in a suspended ceiling system is shown in FIGS. 8 and 9. A suspended ceiling system comprises a series of tiles 80 which lay into a T-bar grid 82 which is suspended from a ceiling by a cable 84 or the like. The frame of the present invention is attached to the T-bar grid of a suspended ceiling system by means of a pair of extruded support members 86. These members, when placed together, comprise a T-shaped slot in the upper surface thereof that fits over the T grid of the suspension system. The bottom portion of the joined members forms a T-shaped flange that fits into the T-shaped slot in the top of the frame. This construction is shown in FIG. 9. In attaching signage to the ceiling in this manner, members 87 are first placed in position on the T grid and then the signage frame is slipped over the T-shaped flange on the lower end of the bracket. The frame itself holds both sides of the bracket together.

As described above, two adjacent sections of frame are held together for a longer sign by means of an I-beam connector 18 as shown in FIG. 8.

Figure 14:
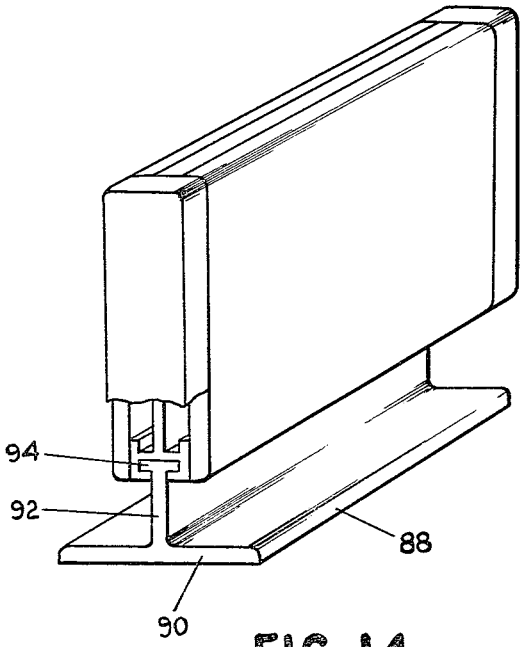
FIG. 14 is a partially broken view showing the signage of the present invention mounted on a desk mounting device.
Figure 15:
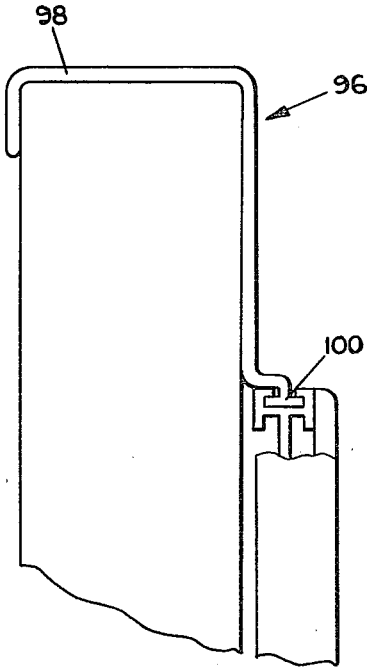
FIG. 15 is a partially broken view showing the wall panel mounting device of the present invention.

A free-standing desk mount 88 is shown in FIG. 14. This mount includes a flat base 90, a vertical section 92, and a T-shaped flange 94 at the top of the vertical section. The T-shaped flange fits in the lower T-shaped slot in the frame in order to hold the sign in vertical position on the mount.

A panel mounting device 96 is shown in FIG. 6. This device can be formed of extruded clear plastic or the like and includes a channel-shaped upper end 98 that fits over the top of a panel and an off-set T-shaped flange 100 on a lower end that fits into the T-shaped slot in the upper end of the frame.

Figure 18A:
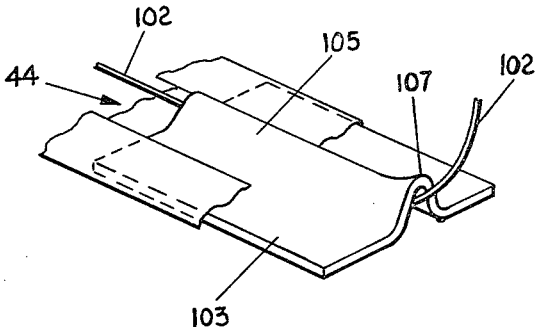
FIG. 18A is a fragmentary perspective view of the mounting device of FIG. 18.
Figure 18:
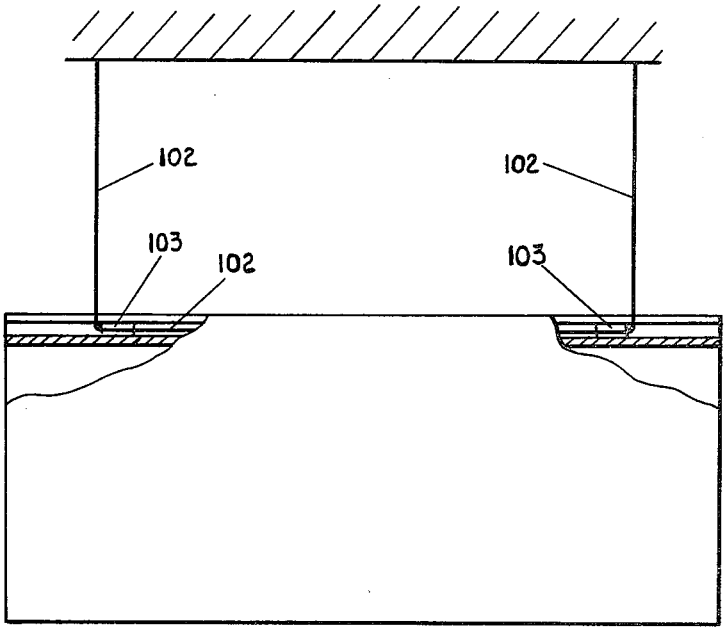
FIG. 18 shows a mounting mechanism for suspending the frame from a ceiling by means of a line or cable.

The ceiling mounting system shown in FIGS. 18 and 18A is used to suspend a sign from a high ceiling. In this application, a cable or line 102 (e.g., 50 pound test fishing line) is suspended from a ceiling and runs through a guide member 103 that is fit into each end of the T-shaped slot at the top of the frame. Each guide member is a flat plate having an arched portion 105 running the length thereof for the line to run through. A flared outer end 107 on the arched portion serves to minimize binding between the line and the guide member.

Figure 19:
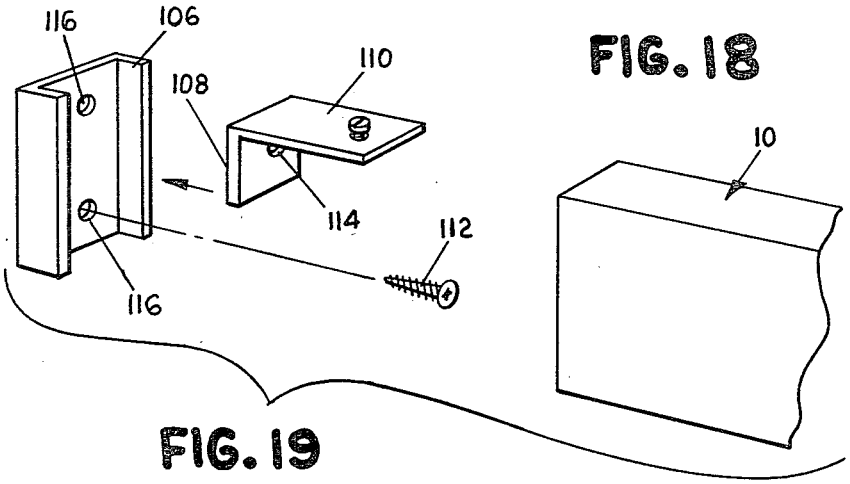
FIG. 19 is an exploded perspective view showing a perpendicular mounting device of the present invention.

One other type of mounting structure for attaching a sign perpendicularly to the side of a wall is shown in FIG. 19. In this device, a vertically oriented U-shaped channel 106 is placed against the wall and a mounting plate 108 having an outwardly extending mounting flange 110 fits within the U-shaped channel. The mounting plate and channel are then fastened as a unit to the wall by threaded fasteners 112 that fit through openings 114 and 116 in the mounting plate and U-shaped channel respectively. The mounting flange 110 fits inside the T-shaped slots in the upper end of the frame. A set screw threaded through the mounting flange can then be tightened to lock the mounting flange in the slot. For long sections of frame a separate mounting plate and flange can be mounted at the bottom of the U-shaped channel and fitted into the T-shaped channel in the bottom of the frame.

Figure 16:
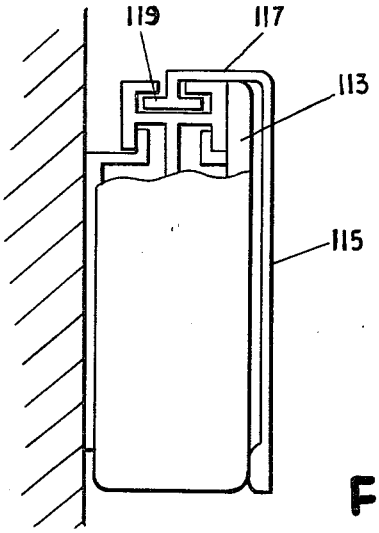
FIG. 16 is a side view showing the use of the present invention in connection with a conference room sign, with the end cap being partially broken away to show sign construction.

A variation of the wall mounted sign is shown in FIG. 16, wherein the signage system is used for a conference room. In such a signage system, it is desirable to be able to indicate when the conference room is vacant or when a conference is in progress. For this application, a long sign 113 indicating "VACANT" at one end and "OCCUPIED" at the other is mounted to or by the conference room door in the manner shown in FIG. 2. A plate 115 having a U-shaped upper portion 117 with a T-flange 119 on the end rides in the T-slot in the upper end of the frame and hangs downwardly over the front of the sign. The plate indicates "CONF. ROOM" or the like and is slid to one side of the sign or the other to expose "VACANT" or "OCCUPIED", whichever is appropriate.

Figure 20:
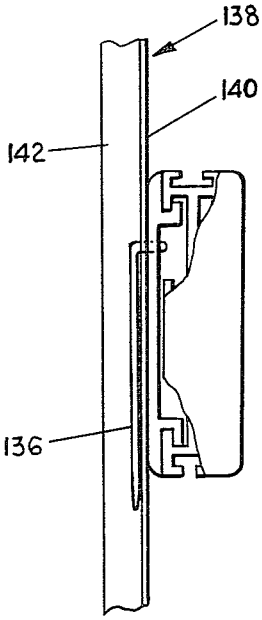
FIG. 20 is a partially broken side view showing the fabric panel wall mounting device of the present invention.
Figure 21:
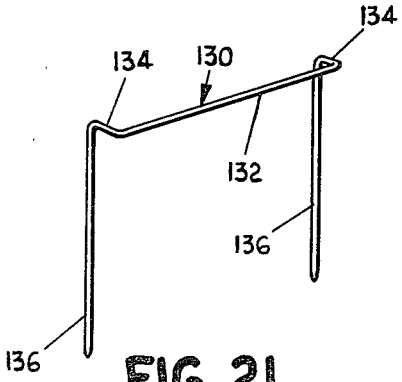
FIG. 21 is a perspective view showing the pin employed in the fabric panel mounting device.
Figure 22:
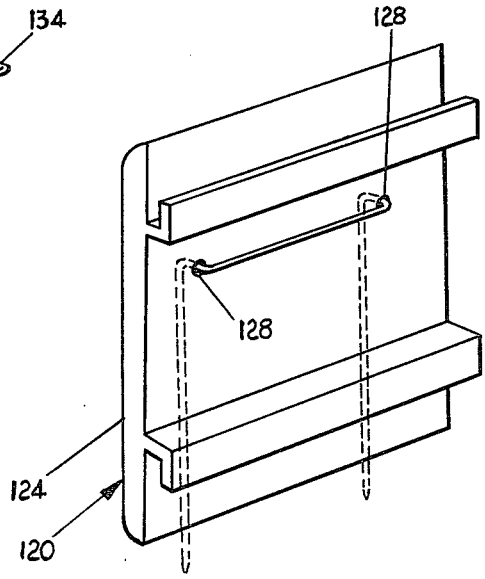
FIG. 22 is another perspective view showing the fabric panel pin mounted in a back plate employed in the fabric panel mounting device.

A device for mounting the signage system of the present invention on a fabric covered panel 138 is shown in FIGS. 20–22. Rather than drilling holes in a fabric-covered panel, it is desirable if the signage system can be mounted to the panel by a pin type of fastener that hooks on to the fabric as opposed to cutting through the fabric. The fabric panel fastening device 120 shown in FIGS. 20–22 comprises a blank lettering insert 124 having a pair of openings 128 spaced horizontally apart thereon. A pin fastener 130 fits through openings 128 in the manner shown in FIG. 22. Pin fastener 130 is formed of a single length of wire and comprises an arm 132 extending between openings 128, perpendicular arms 134 that extend just through openings 128 to the back of the mounting plate, and downwardly extending pointed pins 136 that extend downwardly along the back surface of the mounting plate to a point about one-eighth ($\frac{1}{8}$) inch below the bottom of the sign. The sign is attached to a fabric covered panel 138 by pressing the pins through the fabric covering 140 on the panel so that the pins run downwardly between the fabric covering 140 and the backing 142 of the panel. Thus, it is not necessary to drill a hole in the fabric or the backing for the panel.

Figure 23:
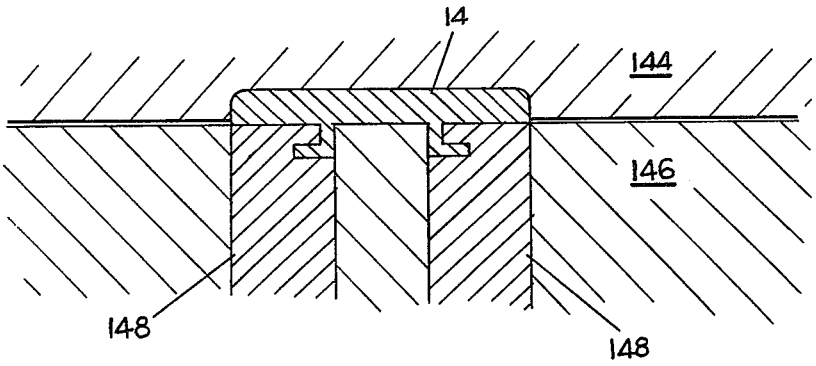
FIG. 23 is a schematic cross sectional side view showing the manner in which injection molded lettering inserts are formed in a press, with the die shown in the closed position.
Figure 24:
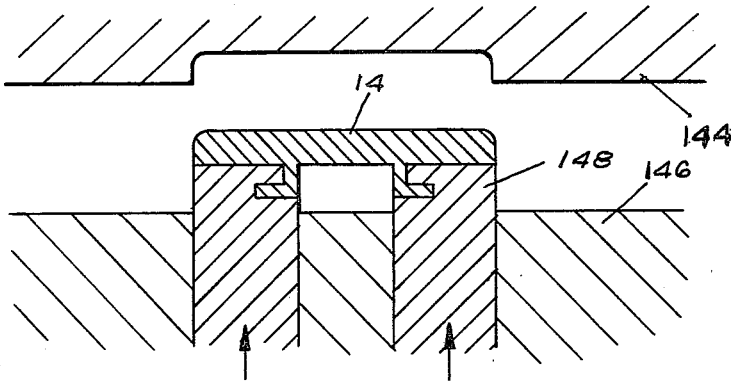
FIG. 24 is a view similar to FIG. 23, with the die shown in the open position and the ejector pins shown in their extended position.

As discussed above in connection with the lettering inserts, a higher degree of manufacturing tolerance can be obtained if the lettering inserts are formed by an injection molding process as opposed to being extruded. Some difficulty would normally be expected in attempting to injection mold a product having L-shaped flanges of the type shown in FIG. 12. However, this is overcome by the molding process shown in FIGS. 23 and 24. In these FIGS., a schematic view of a thermoplastic injection molding machine is shown. This machine includes an upper die half 144 and a lower die half 146 with the lettering insert 14 being formed in a cavity in die half 144. Ejector pins 148 are positioned in lower die half 146 and are extendible upwardly from the lower die half in the manner shown in FIG. 24 in order to eject the part from the die. As shown in these figures, the L-shaped mounting flanges for the lettering insert are formed in the ejector pins themselves as opposed to in the lower die half. With the mounting flanges being formed in the ejector pins, after the part has been formed and the upper die has been raised, the ejector pins are extended to eject the part from the die. The part can then be manually or automatically moved in a horizontal direction so that the part can be slipped out of the slots in the raised ejector pins.

The system of the present invention provides a comprehensive signage system for almost any use. Frames of two, four, six, eight, and twelve inch heights provide multiples that will make it possible to create a sign of almost any desired height. A variety of frame widths can be provided to make it possible to create signs of any desired width.

It should be understood that the foregoing merely represent preferred embodiments of the present invention and that various changes and modifications may be made in these embodiments without departing from the spirit and scope of the present invention.

The embodiments of the invention in which an exclusive property or privilege is claimed are defined as follows:

1. A signage system comprising:

a frame including a vertical support plate having horizontal frame mounting flange means on at least one side thereof, the frame mounting flange means having ends facing the side edges of the support plate;

at least one removable plate-shaped lettering insert mountable on the frame, the lettering insert having signage on the front surface thereof and insert mounting flange means on the back surface thereof, the insert mounting flange means mating with the mounting flange means on the support plate to hold the lettering insert on the frame, the lettering inserts being mountable on the frame by mating the ends of the insert mounting flange means with the ends of the sign mounting flanges on the frame and sliding the lettering insert horizontally across the frame;

removable end caps that cover the ends of the frame and lettering inserts, the end caps comprising at least two opposed resilient fingers that fit over and press resiliently against opposite sides of the support plate to hold the end caps on the frame, the end caps being removable by manually pulling the end caps horizontally away from the frame, thus exposing the ends of the lettering inserts and permitting removal of lettering inserts by sliding them horizontally off the mounting flange means through the opened end; and frame mounting means attachable to the frame for mounting the sign for visual display.

2. A signage system according to claim 1 wherein the end caps are formed in two identical sections, with each section including one of the two opposed resilient fingers.

3. A signage system according to claim 2 wherein the frame mounting flange means for each lettering insert comprises a horizontal T-shaped channel, the mounting flanges on the lettering insert comprising outwardly extending L-shaped flanges that fit in the T-shaped channels so as to permit the lettering insert to slide horizontally along the surface of the plate but restrain the lettering insert from movement in any direction perpendicular to the plate.

4. A signage system according to claim 3 wherein the frame comprises a plurality of T-shaped horizontal channels spaced vertically along the surface thereof, with the channels being spaced apart a predetermined distance, the frame including at least two vertically spaced T-shaped channels on each side thereof, and the end cap covering the entire length of the frame, the end cap including at least two pair of opposed resilient fingers positioned so as to engage the support plate on the interior of each of the two horizontally disposed T-shaped channels, the end cap further comprising a pair of alignment tabs that fit between the horizontally disposed T-shaped channels so as to position the end caps in proper vertical position on the frame.

5. A signage system according to claim 3 wherein the frame comprises a plurality of T-shaped horizontal channels spaced vertically along the surface thereof, with the channels being spaced apart a predetermined distance, the frame including at least two vertically spaced T-shaped channels on each side thereof, the end cap covering the entire length of the frame, the end cap further including alignment tab means for positioning the end cap in proper vertical alignment on the frame, the alignment tab means protruding from the end cap so as to fit into the frame in a manner such that the end cap is held in proper vertical alignment on the frame.

6. A signage system according to claim 1 wherein the frame comprises an upwardly facing T-shaped slot on the top of the frame and a downwardly facing T-shaped slot on the bottom of the frame, the frame mounting means being attachable to the frame by the upper or lower T-shaped slot on the frame.

7. A signage system according to claim 6 wherein two adjacent sections of the frame are interconnected by means of an I-beam shaped connector that interconnects the lower T-shaped slot on one section of frame with the upper T-shaped slot on a lower section of frame.

8. A signage system according to claim 1 wherein the frame includes mounting flanges on both sides of the support plate, with the lettering inserts being mounted on one side of the frame and the other side of the frame being mounted against a wall, the frame being mounted against the wall by means of a mounting plate having outwardly extending flanges that engage the mounting flanges on the back of the frame, the mounting plate being attached to the wall by a threaded fastener.

9. A signage system according to claim 6 wherein the frame mounting means comprises a pair of mating extruded members that fit together to form a T-shaped slot in the upper surface thereof that fits over a T-shaped support member of an exposed grid ceiling system, the members further providing a T-shaped mounting flange at the lower end thereof when placed together, the T-shaped mounting flange fitting in the T-shaped slot in the upper surface of the frame, the frame holding the two members together on the T-shaped support member for the ceiling system.

10. A signage system according to claim 4 and further comprising alignment projections extending outwardly from the back of the insert, the alignment projections fitting between the adjacent sections of T-shaped horizontal channels on the surface of the vertical support plate so as to hold the insert in proper vertical alignment on the support plate, the insert being sufficiently high so as to cover at least two channels in the support plate, the insert comprising a lower mounting flange that engages the lower side of the lower channel on the vertical plate and upper mounting flange that engages the upper side of the upper channel of the mounting plate.

11. A signage system according to claim 6 wherein the frame mounting means comprises a mounting plate that is attached to the wall by means of a threaded fastener, the mounting plate having a mounting flange extending perpendicularly therefrom, the mounting flange fitting inwardly into the end of the T-shaped slot on the upper edge of the frame, the mounting flange including threaded tightening means for locking the frame in position on the mounting flange.

12. A signage system according to claim 1 wherein the frame mounting means comprises a means for mounting the frame on a fabric covered panel comprising a fabric overlaying a panel backing, the means comprising a backing plate having mounting flanges that engage mounting flanges on the rear of the frame, said means further comprising a U-shaped wire pin fastener having legs in the form of pin elements that fit through openings in the mounting plate and then extend downwardly in a direction parallel to the backing plate, the pin elements extending downwardly to a point slightly below the bottom of the frame and backing plate, the pin elements being capable of piercing the fabric backing and extending vertically downwardly between the fabric covering and the hardboard backing of the panel.

13. A signage system comprising:

a double faced frame including a vertical mounting plate having a series of horizontal mounting flanges vertically spaced on both sides of the plate;

a plurality of lettering inserts having mounting flanges on the rear sides thereof that are matable with the mounting flanges on the frame to hold the lettering inserts on the frame, the respective mounting flanges being formed such that the lettering inserts are mounted on the frame by sliding the inserts in a sideways direction across the frame from the side edge of the frame with the respective mounting flanges in mating engagement, the mounting flanges permitting the lettering inserts to slide sideways across the frame but restraining the lettering inserts from vertical or perpendicular movement with respect to the frame, the lettering inserts being mountable on the frame so as to cover the mounting flanges on which the inserts are mounted;

end caps that resiliently clip on the side edges of the frame so as to enclose the side edges of the frame and the ends of the lettering inserts, the lettering inserts being non-removable from the frame when the end caps are fitted on the frame, the end caps including concealed resilient retaining means that engage the frame and resiliently hold the end caps on the frame, the end caps being mountable on the frame without any tools by pushing the end caps inwardly on the frame and being removable from the frame by pulling the end caps outwardly from the frame; and frame mounting means attachable to the frame for positioning the sign for visual display.

14. A signage system according to claim 13 wherein the end caps have inner surfaces that abut and cover the end surfaces of the lettering inserts and the frame but the end caps do not cover the top or bottom or front surfaces of the frame or lettering inserts, the retaining means extending outwardly from the inner surface of each cap such that it extends into the interior portion of the frame behind the lettering inserts, the retaining means comprising a pair of resilient fingers that resiliently engage the frame and hold the end cap in position on the frame.

15. A signage system according to claim 13 wherein the frame includes an upwardly facing T-shaped channel on the top edge thereof and the frame mounting means includes a pair of guide members that fit in the T-shaped channel at spaced locations along the channel, the frame mounting means further comprising a flexible line that extends from a ceiling attachment point at one end downwardly to the frame, then extends laterally under both guide members, and finally extends upwardly to a ceiling attachment point at the other end of the line.

* * * * *